US008739675B2

(12) United States Patent
Tunis et al.

(10) Patent No.: US 8,739,675 B2
(45) Date of Patent: Jun. 3, 2014

(54) ARMOR PANEL SYSTEM TO DEFLECT INCOMING PROJECTILES

(75) Inventors: George C. Tunis, Berlin, MD (US); Scott Kendall, Berlin, MD (US); Stephen L. Kinnebrew, Crisfield, MD (US)

(73) Assignee: Hardwire, LLC, Pocomoke, MD (US)

( * ) Notice: Subject to any disclaimer, the term of this patent is extended or adjusted under 35 U.S.C. 154(b) by 1352 days.

(21) Appl. No.: 12/288,443

(22) Filed: Oct. 20, 2008

(65) Prior Publication Data

US 2012/0186424 A1 Jul. 26, 2012

Related U.S. Application Data

(60) Provisional application No. 60/999,652, filed on Oct. 19, 2007, provisional application No. 61/062,036, filed on Jan. 23, 2008.

(51) Int. Cl.
*F41H 5/04* (2006.01)

(52) U.S. Cl.
CPC ..... *F41H 5/0471* (2013.01); *F41H 5/0478* (2013.01)
USPC ..... 89/36.02; 89/36.08; 89/914

(58) Field of Classification Search
CPC ..... F41H 5/04; F41H 5/0471; F41H 5/0478; F41H 5/0485
USPC ..... 89/36.02, 909, 914, 915, 916, 36.08, 89/908, 912, 913, 917; 428/911
See application file for complete search history.

(56) References Cited

U.S. PATENT DOCUMENTS

| | | | | |
|---|---|---|---|---|
| 2,318,301 | A | | 5/1943 | Eger |
| 3,380,406 | A | * | 4/1968 | Gosnell ..... 109/80 |
| 3,616,115 | A | | 10/1971 | Klimmek |
| 4,293,405 | A | | 10/1981 | Greenwald |
| 4,318,803 | A | | 3/1982 | Holmgren |
| 4,325,283 | A | | 4/1982 | Bemiss |
| 4,719,151 | A | | 1/1988 | Chyung et al. |
| 4,990,253 | A | | 2/1991 | Vcelka |
| 5,007,326 | A | | 4/1991 | Gooch, Jr. et al. |
| 5,170,690 | A | | 12/1992 | Smirlock et al. |
| 5,198,280 | A | | 3/1993 | Harpell et al. |
| 5,340,633 | A | | 8/1994 | van der Loo et al. |
| 5,591,933 | A | | 1/1997 | Li et al. |
| 5,637,375 | A | | 6/1997 | Hohman |

(Continued)

FOREIGN PATENT DOCUMENTS

| | | |
|---|---|---|
| GB | 554856 | 6/1943 |
| GB | 2 232 063 | 5/1990 |
| WO | WO 91/00490 | 1/1991 |
| WO | WO 01/59395 | 8/2001 |

OTHER PUBLICATIONS

HB2 Product Specification Sheet, Dyneema, Jan. 2006.
HB25 Product Specification Sheet, Dyneema, Oct. 2006.

(Continued)

*Primary Examiner* — Stephen M Johnson
(74) *Attorney, Agent, or Firm* — McLane, Graf, Raulerson & Middleton, PA

(57) ABSTRACT

An armor panel system has a projectile-deflecting section having an outwardly facing surface. The projectile-deflecting section is formed of a material arranged in parallel layers, the layers arranged at a non-parallel angle to the outer surface. The non-parallel angles deflect or rotate an incoming projectile.

6 Claims, 15 Drawing Sheets

(56) References Cited

U.S. PATENT DOCUMENTS

| | | | | |
|---|---|---|---|---|
| 5,654,077 | A * | 8/1997 | Wu et al. | 428/141 |
| 5,723,807 | A | 3/1998 | Kuhn, II | |
| 6,408,733 | B1 | 6/2002 | Perciballi | |
| 6,641,893 | B1 * | 11/2003 | Suresh et al. | 428/105 |
| 7,080,587 | B2 * | 7/2006 | Benyami et al. | 89/36.08 |
| 7,087,296 | B2 * | 8/2006 | Porter | 428/223 |
| 7,163,731 | B2 | 1/2007 | Yeshurun et al. | |
| 7,866,248 | B2 | 1/2011 | Moore, III et al. | |
| 2001/0053645 | A1 | 12/2001 | Henderson | |
| 2002/0037409 | A1 | 3/2002 | Tunis | |
| 2002/0058450 | A1 | 5/2002 | Yeshurun et al. | |
| 2004/0216595 | A1 | 11/2004 | Dickson | |
| 2006/0252328 | A1 | 11/2006 | Bingenheimer | |

OTHER PUBLICATIONS

HB50 Product Specification Sheet, Dyneema, Jan. 2007.

* cited by examiner

ARMOR PANEL SYSTEM TO DEFLECT INCOMING PROJECTILES

CROSS REFERENCE TO RELATED APPLICATIONS

This application claims the benefit under 35 U.S.C. §119 (e) of U.S. Provisional Application No. 60/999,652, filed on Oct. 19, 2007, and U.S. Provisional Application No. 61/062,036, filed on Jan. 23, 2008, the disclosures of which are incorporated by reference herein.

STATEMENT REGARDING FEDERALLY SPONSORED RESEARCH OR DEVELOPMENT

This invention was made with Government support under Agreement No. HR0011-06-9-0008, awarded by DARPA. The Government has certain rights in the invention.

BACKGROUND OF THE INVENTION

Ballistic and blast resistant armor panels are well known and take on a variety of configurations for providing armor to buildings, vehicles, ships, airplanes and a variety of other applications where armor is required. In addition to typical projectiles, it is also desirous to stop high velocity armor piercing weapons.

Most armor piercing projectiles rely on a hard material in a pointed rod-like form (e.g. hardened steel, tungsten carbide). Many are fired from conventional weapons, and have a soft metal casing of copper or lead. The actual armor piercing element is considerably smaller than the caliber of the weapon. For example an M-993AP round is 30 caliber, with a diameter of 0.300", and a hard tungsten carbide penetrator 0.221" in diameter encased in copper. The point of the penetrator develops very high stress on contact, while the hard nature of the penetrator material allows it to maintain high stress without failing, causing the target to fail (crush, deform, melt, or vaporize). Further, the long rod-like shape allows a large amount of kinetic energy to be applied to a small area.

One method used to defeat an armor piercing threat is to use a hard surface to blunt, crack, and/or fragment the projectile so that it can then be stopped more easily. For example, a ceramic may be used as the first surface, with a metal such as aluminum as the second layer, and a composite material laminate as a layer to catch the fragments.

Attempts have been made to facilitate deflection (and rotation) of projectiles. Examples include an array of ceramic balls, in two or more non-aligned layers, to create a somewhat torturous path for the penetrator, in which it is not possible to find a straight path that intersects a ball surface at an angle. The balls need to be of substantial weight in comparison to the projectile in order to have a significant effect, and such weight is not efficient.

Another design uses short ceramic cylinders with rounded ends, suspended in a soft matrix, but suffer similar shortcomings as the array of balls. Other attempts include a wavy surface, with peaks and valleys, some with a spherical indentation in a square ceramic tile, to thicken the tile in the corners and try to offer non-flat surfaces. All of these attempts have fallen short of providing the glancing effect at all positions on a panel and at all trajectory angles. There is always a way to hit the panel at 90° to the primary stopping interface, at some position and angle.

In U.S. Pat. No. 5,007,326, metal layers with holes present oblique surfaces to the projectile in an effort to break up the projectile.

SUMMARY OF THE INVENTION

An armor panel system has a projectile-deflecting section having an outer surface. The projectile-deflecting section is formed of a macroscopically orthotropic material or a material arranged in parallel layers, the layers arranged at a non-parallel angle to the outer surface.

An armor piercing penetrator tends to glance off a ceramic or metallic surface, but once it does penetrate, there is nothing to continue the glancing effect once it is inside, and it may continue through. The present invention obviates this problem by using macroscopically orthotropic materials. Multilayer materials and orthotropic materials continue to create asymmetrical loads tending to rotate the projectile, as long as it is moving through the material at an angle to the layers, or in the case of an orthotropic material, at an angle to one or more of the planes of material symmetry.

DESCRIPTION OF THE DRAWINGS

The invention will be more fully understood from the following detailed description taken in conjunction with the accompanying drawings in which.

DETAILED DESCRIPTION OF THE INVENTION

The disclosures of U.S. Provisional Application No. 60/999,652, filed on Oct. 19, 2007, and U.S. Provisional Application No. 61/062,036, filed on Jan. 23, 2008, are incorporated by reference herein.

An armor panel system utilizes a material in which the outer surface of the material is not parallel with any plane of material symmetry of the layers of the material, to deflect an incoming projectile. The worst condition for an armor panel is usually when a projectile threat hits at 90° to the surface. When the projectile hits at an angle less than 90°, a redirecting or glancing effect tends to rotate the projectile. If the angle is sufficiently low, the projectile may bounce off or ricochet from the surface. Thus, if the penetrator can be redirected or turned sideways somewhat, so that its primary axis is no longer parallel with its initial trajectory, it may be stopped more easily, and in a more conventional manner. In the present armor panel system, the orthotropic material provides the mechanism by which the projectile is deflected or rotated from its initial trajectory.

Figure 1B:
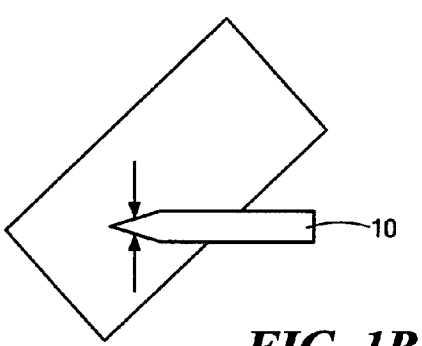
FIGS. 1A and 1B schematically illustrate movement of a projection through an isotropic material.
Figure 1A:
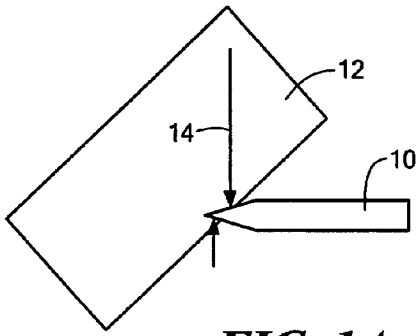

Referring to FIGS. 1A and 1B, as a penetrator strikes an isotropic material 12 at an oblique angle, there is greater engaged area on one side tending to push the penetrator in a lateral direction (indicated by arrow 14 in FIG. 1A), tending to rotate the projectile. Once the tip of the penetrator enters the material, the deflection forces become more balanced, and the tendency to push the projectile in a lateral direction is, for practical purposes, eliminated (FIG. 1B).

Figure 2:
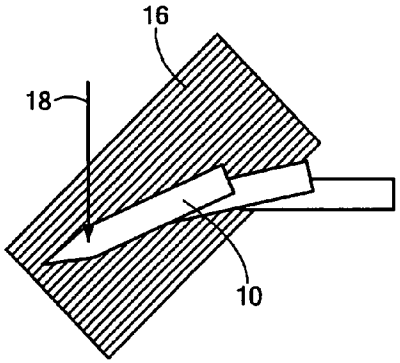
FIG. 2 schematically illustrates movement of a projectile through an orthotropic material.

Referring to FIG. 2, as a penetrator 10 enters a layered material 16 at an angle, such as 45°, to one or more of the planes of material symmetry, a lateral force continues to be created (indicated by arrow 18), tending to rotate the penetrator as it is moving through the material. A simple view of the layered material effect could be that the layered material continues to present new oblique surfaces to the projectile as it passes through, continuing the rotational effect.

Figure 3B:
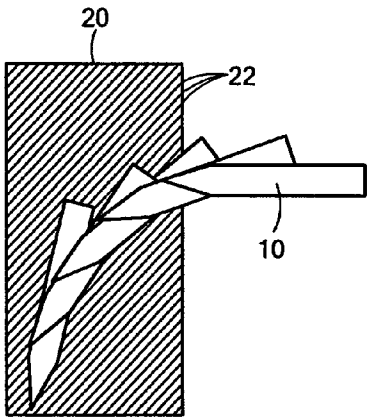
FIGS. 3A and 3B further schematically illustrate movement of a projectile through an orthotropic material.
Figure 3A:
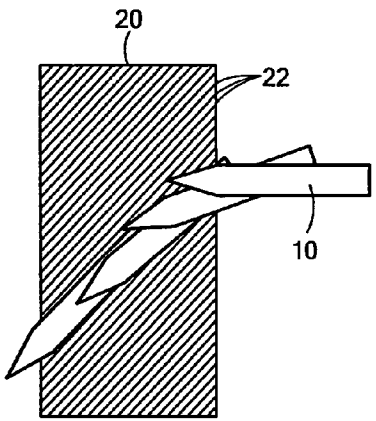

A similar effect can be realized for penetrators 10 hitting a surface at 0° angle to the surface normal, by rotating the material plies 22 within the panel 20. See FIGS. 3A and 3B. This allows the penetrator 10 to be deflected as though it is hitting an angled surface, because it is effectively hitting an angled surface, and will continue to be deflected throughout the material. The projectile 10 may rotate until it is aligned with the layers, effectively splitting the layers as it moves. See FIG. 3A. In some cases, the projectile may continue to rotate beyond this alignment, continuing to sweep an arc through the material. See FIG. 3B.

Figure 4:
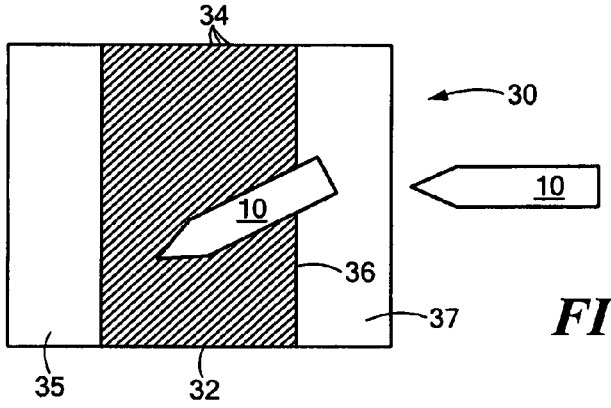
FIG. 4 is a schematic illustration of an armor panel having a projectile-deflecting section incorporating an orthotropic material and illustrating movement of a projectile therethrough.

FIG. 4 illustrates an embodiment of an armor panel 30 having a projectile-deflecting section 32 incorporating a macroscopically orthotropic material formed by a laminate material comprised of layers 34 that are arranged at a non-parallel angle to an outer surface 36. The angle is suitably 10° to 90° and preferably approximately 45°. The orthotropic material is sandwiched between an inner ballistic layer(s) 35 and an outer ballistic layer(s) 37. The outer layer(s) is provided to hold the laminate material to the inner ballistic layer(s). A projectile 10 striking the outer surface at 90° rotates as it moves through the orthotropic material. The rotated projectile can then be captured or defeated more easily by the inner ballistic layer(s) 35.

As used herein, orthotropic materials are generally considered to be anisotropic materials, which are further classified to have three mutually perpendicular planes of material symmetry. The term macroscopically orthotropic is used to describe an assembly of materials that may be isotropic in themselves, but the assembly behaves in an orthotropic manner when viewed at a large enough scale. An example of this is a fiberglass cloth impregnated with a plastic resin. Each of the constituents would be considered isotropic in themselves at a microscopic level, but the assembly is considered to act as an orthotropic material for engineering purposes, with properties that depend on direction within the material.

The planes defined by the layers of a material also define one of the planes of material symmetry of an orthotropic material. The layers may also be curved, and remain locally orthotropic. Cylindrically or spherically orthotropic materials are possible orthotropic configurations; the layers do not have to be flat. An example of a cylindrically orthotropic material could be made by wrapping layers around a cylindrical shape.

Figure 5:
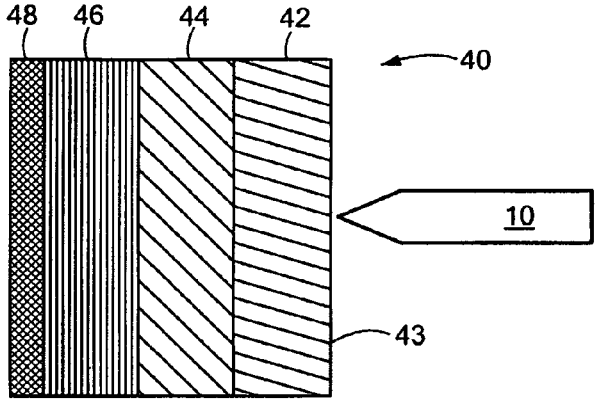
FIG. 5 schematically illustrates an armor panel with multiple sequential sections at decreasing angles with respect to the surface plane.
Figure 6:
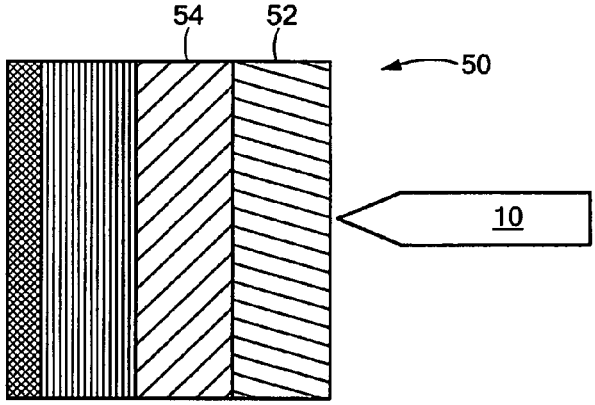
FIG. 6 schematically illustrates an armor panel with multiple sections having reversed angles.
Figure 7:
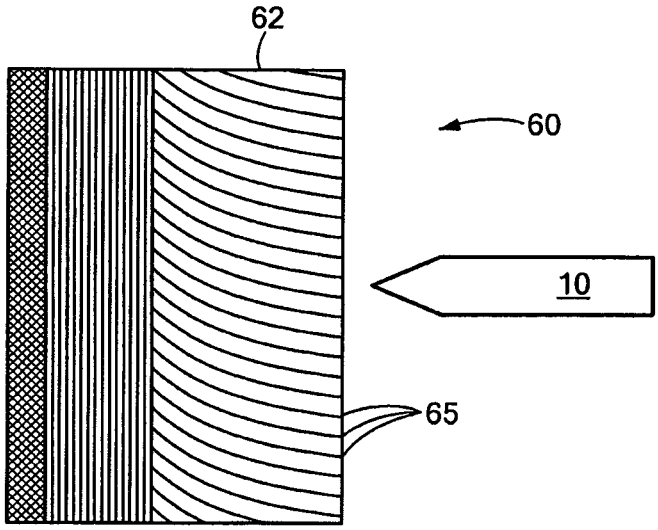
FIG. 7 schematically illustrates an armor panel with curved layers.

Multiple angled projectile-deflecting sections can be employed, as illustrated in FIG. 5, to more effectively initiate the rotation of the projectile and then to continue the rotation effect. In the armor panel 40 of FIG. 5, the first section 42 has layers angled at 75° to the surface plane 43, and the second section 44 has layers angled at 45° to the surface plane. More than two angled sections can be used, such as three, four, or more sequential sections, with sequentially changing angles, to gain the desired effect. Two inner ballistic layers 46, 48 are also used in this embodiment. FIG. 6 illustrates an armor panel 50 with sections 52, 54 in which the angle is reversed, which can also provide an advantage. FIG. 7 illustrates a panel 60 employing the concept of multiple sequential sections with monotonically changing angles taken to the limit in a single section 62 with curved layers 65.

Figure 8:
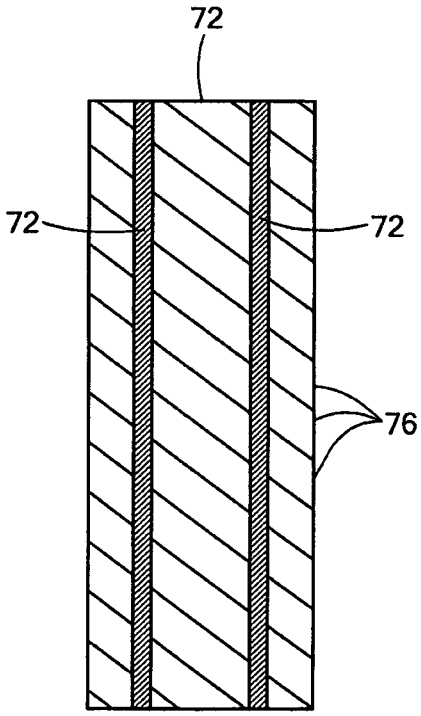
FIG. 8 schematically illustrates an armor panel with reinforcement through the section.
Figure 9:
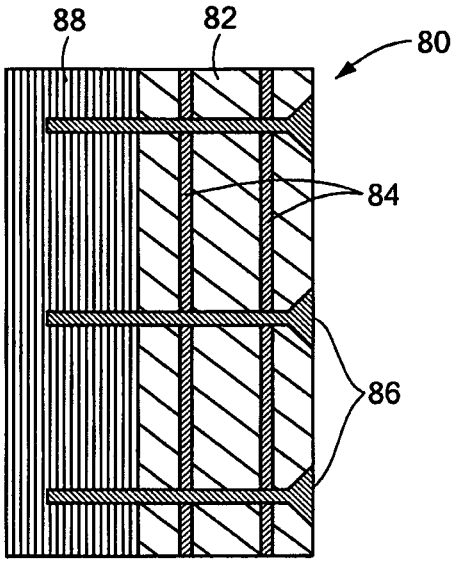
FIG. 9 schematically illustrates an armor panel with additional screw reinforcement through the section.
Figure 10:
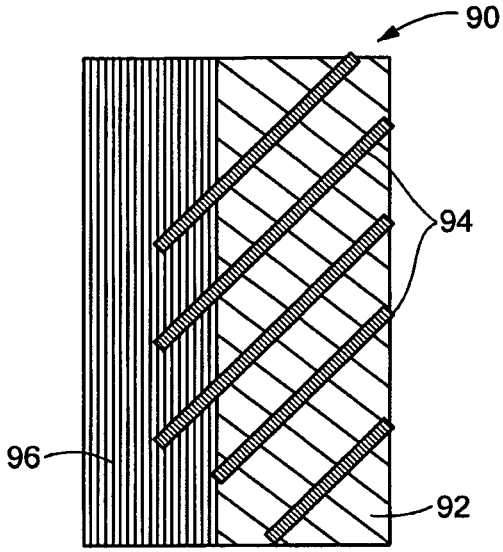
FIG. 10 schematically illustrates an armor panel with reinforcement in a direction perpendicular to the angled layers.

Since the layered materials can be weak in the through-the-thickness direction, this direction can be reinforced. In one embodiment (for example, FIG. 4), surface layers 37 can be added to the panel to hold it together. In another embodiment, referring to FIG. 8, a panel 70 employs reinforcing items such as fibers, wires, rods, screws, or bars 74 to tie together the layers 76 of the section 72. These reinforcing items can be bonded to the layers to increase their effectiveness. Such reinforcing of this direction adds to the panel's performance, multi-hit capability, and overall survivability. FIG. 9 illustrates a panel 80 using screws 86 in addition to bars 84 to further reinforce the layers of the section 82 as well as secure the layers to the section 88 behind. FIG. 10 illustrates a panel 90 in which reinforcing fibers, wires, rods, screws or bars 94 are used in a direction perpendicular to the angled layers of the section 92. Such reinforcement may or may not extend into the section 96 behind.

Examples of suitable orthotropic materials for the angled section include layers of unidirectional ultra high molecular weight polyethylene fiber in a urethane matrix, such as that commercially available under the name DYNEEMA®, pressed into a laminate. The laminate can be made up of layers alternating at 90°, 0°, 90°, 0°, 90°, etc., with respect to the outer surface or of layers alternating at +45°, −45°, +45°, −45°, etc., with respect to the outer surface. Another laminate can be made up of layers alternating at 0°, 90°, +45°, −45°, 0°, 90°, +45°, −45°, etc.

Other materials can include woven materials such as layers of aramid fiber (e.g., KEVLAR®) cloth in a plastic resin, layers of S-glass cloth in a plastic resin, layers of E-glass cloth in a plastic resin, and layers of unidirectional S-glass in a plastic resin.

Orthotropic materials can also include layers of otherwise isotropic materials, such as alternating layers of steel and plastic.

An armor panel could also be made with one block of angled material, but it is generally preferable when used as a component in a multi-layer system or as an add-on to an existing system.

Figure 11:
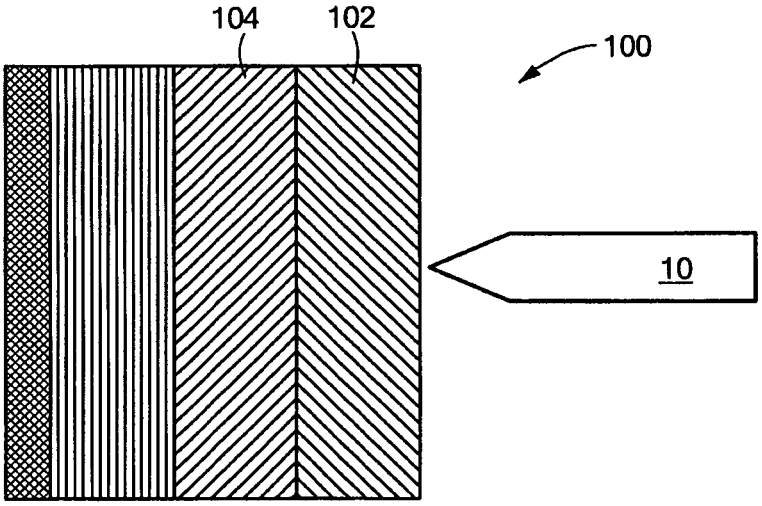
FIG. 11 schematically illustrates an armor panel with alternating 45° angles.
Figure 12:
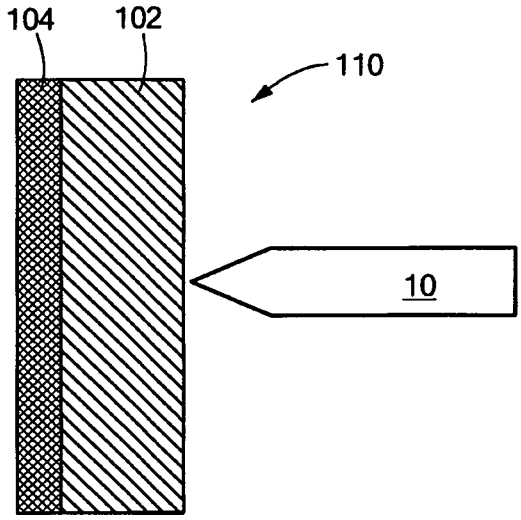
FIG. 12 schematically illustrates a single angled section on a monolithic backer particularly suitable as a upgrade on an existing armor system.
Figure 13:
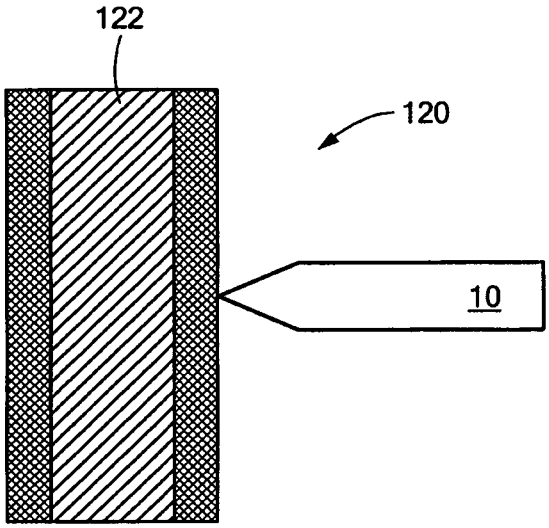
FIG. 13 is schematically illustrates a further embodiment in which an angled section is provided internally.
Figure 14:
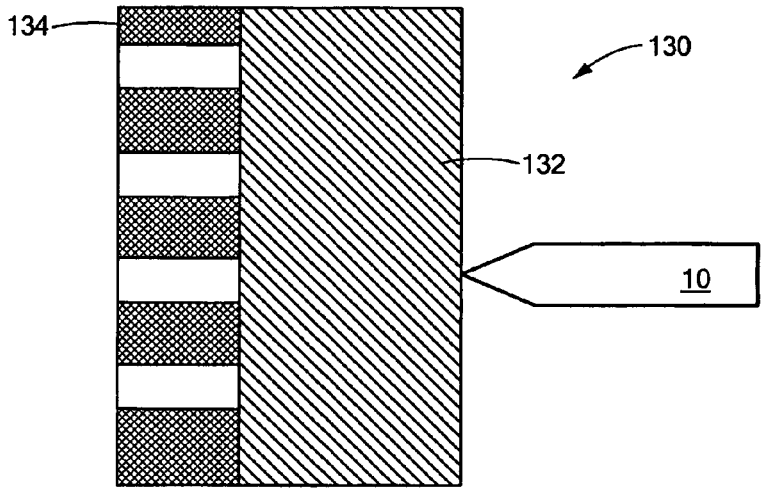
FIG. 14 schematically illustrates a further embodiment with angled layers in front of perforated armor.

Some further configurations of armor panels incorporating angled material are shown in FIGS. 11-14. FIG. 11 illustrates a panel 100 with a further alternating angled configuration, in which the outermost section 102 is angled at +45° and the inner section 104 is angled at −45°. FIG. 12 illustrates a panel 110 with a single angled section 102 on a monolithic backer 104, such as metal, aluminum, steel, or ceramic. This embodiment is particularly suitable as an upgrade to an existing armor system. FIG. 13 illustrates a panel 120 with an angled section 122 provided as an internal layer. FIG. 14 illustrates a panel 130 with a section 132 of angled layers used in front of conventional perforated armor 134, which may be metallic, ceramic, or another type, to facilitate projectile rotation before the perforated armor and breakup of the projectile as it strike the perforations in a rotated attitude.

Figure 15:
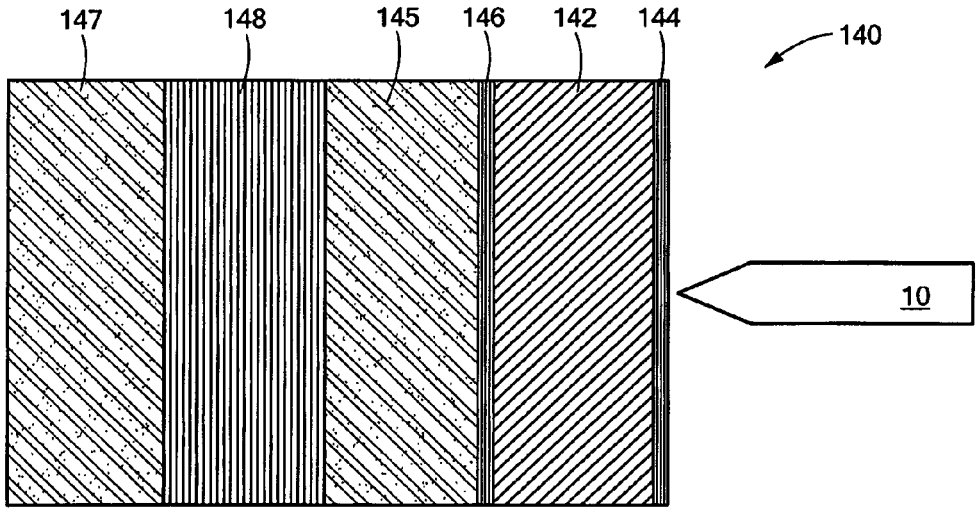
FIG. 15 schematically illustrates an embodiment of an armor panel utilizing an orthotropic material.

In one example that has been tested (FIG. 15), an armor panel 140 is made of a stack of several component sections. The primary projectile-deflecting section 142 is comprised of layers of ultra high molecular weight polyethylene fibers embedded in a matrix material, such as DYNEEMA® material, arranged at an angle of 45° to the outer surface. This section is about 1.4 inches thick in this example. The projectile-deflecting section is sandwiched between two thinner layers of material 144, 146, about 0.05 inch thick, to help hold the projectile-deflecting section together. One of the thinner layers 144 forms the outer surface of the armor panel. In the example, the thinner layers also are comprised of layers of DYNEEMA® material arranged in planes of alternating angles of 0° and 90°, parallel to the outer surface. Other suitable materials, such as thin metal or other composites, could be used.

Behind the projectile-deflecting section 142, two sections of a PVC plastic foam 145, 147 are used as a standoff, each 1.5 inches thick. Between the two foam sections is a further armor panel section comprised of, for example, layers of DYNEEMA® material about 1.5 inches thick arranged in planes of alternating angles of 0° and 90°, parallel to the outer surface.

This armor panel example was successfully tested against M2AP and M993AP 30 caliber projectiles.

Figure 16:
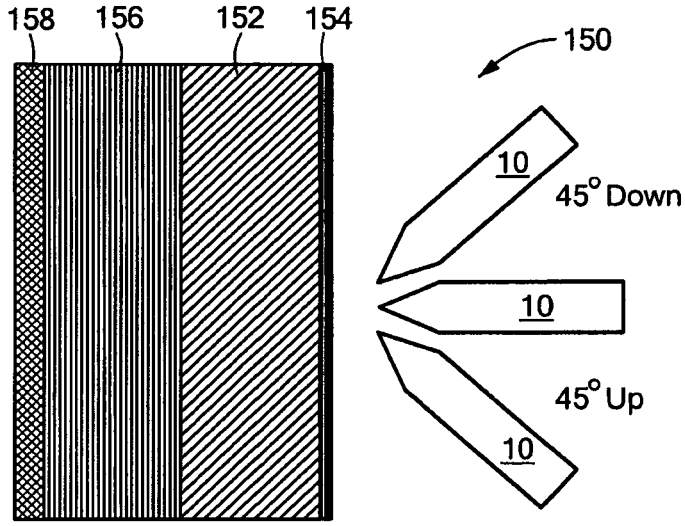
FIG. 16 schematically illustrates a further embodiment of an armor panel utilizing an orthotropic material.

In a further example that has been tested (FIG. 16), the armor panel 150 also has a primary projectile-deflecting section 152 comprised of layers of DYNEEMA® material arranged at an angle of 45° to the outer surface. This section is about 1.4 inches thick. The outer surface is a 5-ply laminate 154 of DYNEEMA® material, arranged in planes of alternating angles of 0° and 90°, parallel to the outer surface. The back of the projectile-deflecting section is a further section 156 of DYNEEMA® material, arranged in planes of alternating angles of 0° and 90°, parallel to the outer surface, and having a thickness of 1.6 inches. An inner surface is formed of a metal layer 158, in this case 0.140 inch thick RHA steel.

This example was able to resist M2AP and M993AP projectiles at angles of 45° up or down and 0° (normal to the outer surface). The steel backing was not damaged.

Figure 17:
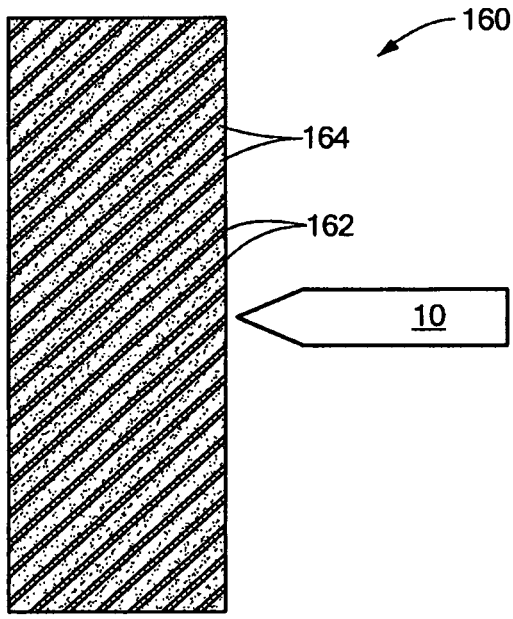
FIG. 17 schematically illustrates a still further embodiment of an armor panel utilizing an orthotropic material.

In a further embodiment (FIG. 17), a panel 160 includes alternating layers 162, 164 of isotropic materials are arranged at an angle of 45° to the outer surface. The isotropic materials can be, for example, steel, ceramic, and plastics. This layered and angled arrangement results in an orthotropic material on a macroscopic scale. A wide variety of plastics, such as polyethylene and polypropylene, can be used.

A generally anisotropic material in which the planes of material symmetry are not mutually perpendicular, can be used. Thus, in addition to no plane of material symmetry that is parallel with the outer surface, no plane of material symmetry is perpendicular to the outer surface as well.

Figure 22:
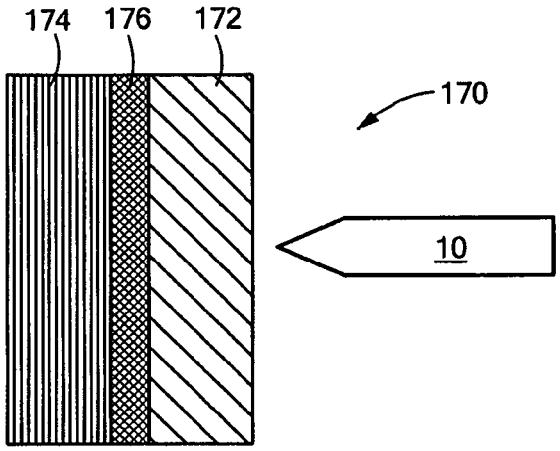
FIG. 22 schematically illustrates a further embodiment incorporating a ceramic layer between an outer projectile-deflecting section and an inner catcher layer.

In another embodiment, illustrated in FIG. 22, a panel 170 has an outer projectile-deflecting section 170 in conjunction with an inner composite material catcher layer 174, such as of DYNEEMA® material. A ceramic layer 176 is placed as an intermediate layer between the outer projectile-deflecting section and the inner catcher layer, leading to improved performance.

Figure 23:
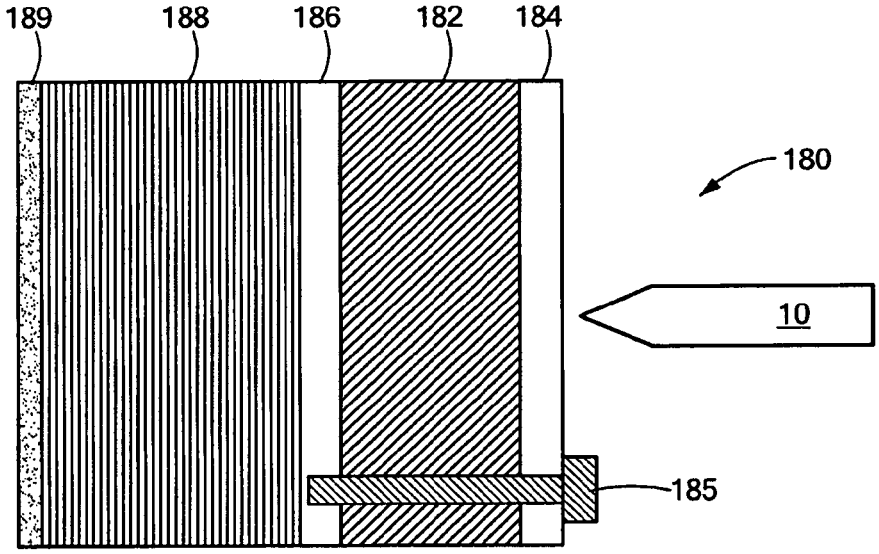
FIG. 23 schematically illustrates a further embodiment of an armor panel utilizing a projectile-deflecting section.

FIG. 23 illustrates a further embodiment of a panel 180 in which a projectile-deflecting section 182 is formed of layers of ultra high molecular weight polyethylene fibers embedded in a matrix material, such as DYNEEMA® material, arranged at an angle of 45° to the outer surface. The projectile-deflecting layer is sandwiched between layers of metal 184, 186, such as aluminum alloy 7075-T651, for example, 0.25 inch thick. Bolts 185 are provided for further reinforcement and to secure the projectile-deflecting layer to the metal sandwich layers. An inner section 188 of layers of ultra high molecular weight polyethylene fibers embedded in a matrix material, such as DYNEEMA® material, is arranged with the layers parallel to the outer surface. An inner surface is formed of a metal layer 189, in this case 0.140 inch thick RHA steel.

Figure 24:
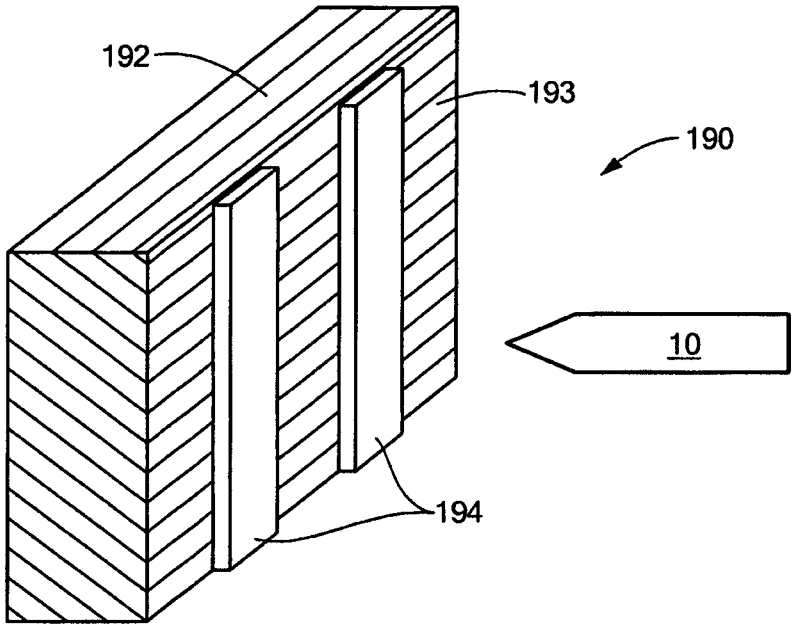
FIG. 24 schematically illustrates a further embodiment of a projectile-deflecting section incorporating reinforcing strips.
Figure 25:
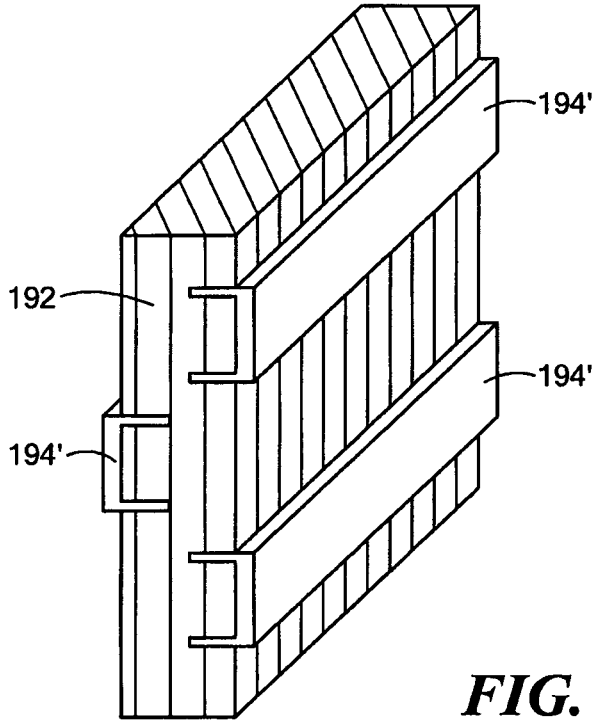
FIG. 25 schematically illustrates a further embodiment of a projectile-deflecting section incorporating reinforcing strips having a C-channel configuration.
Figure 26:
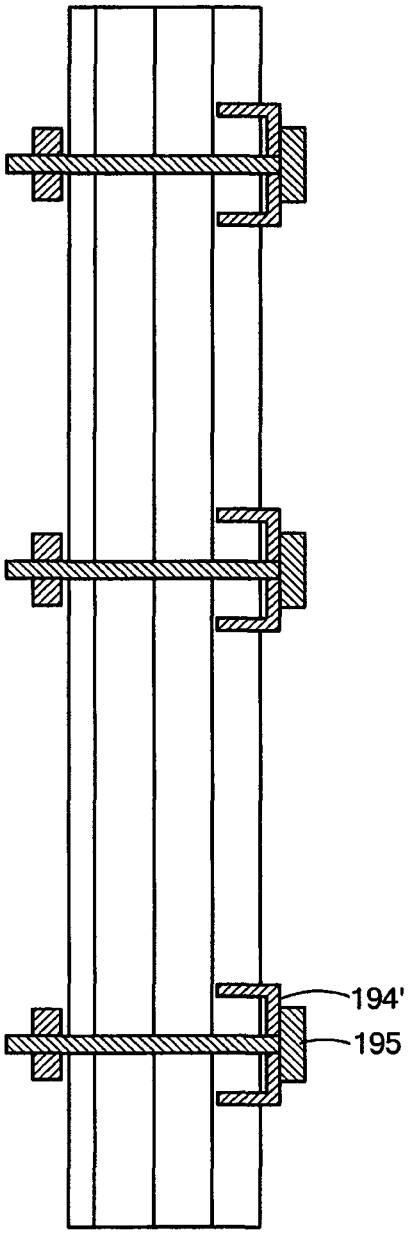
FIG. 26 schematically illustrates a further embodiment of a projectile-deflecting section incorporating C-channel reinforcing strips and bolts.
Figure 27:
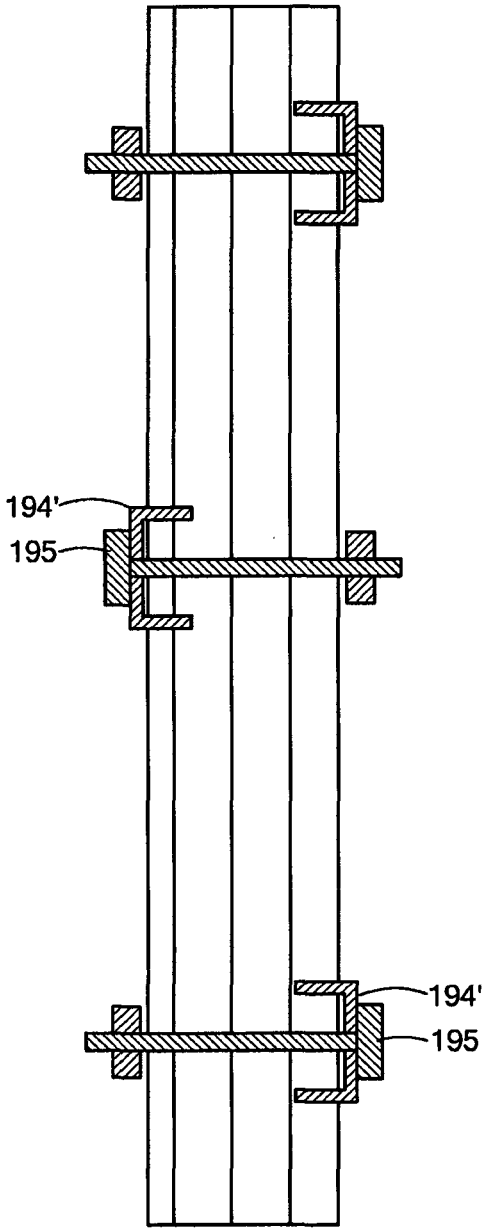
FIG. 27 schematically illustrates a further embodiment of a projectile-deflecting section incorporating C-channel reinforcing strips and bolts on alternating sides of the section.

A further embodiment of a panel 190 is illustrated in FIG. 24, in which strips 194 are affixed, such as with bolts (not shown in FIG. 24), to the outer surface 193 of the projectile-deflecting section 192 to aid in reinforcing the through-the-thickness direction. The reinforcing strips are oriented perpendicular to the edges of the layered projectile-deflecting section. The strips can have other configurations, such as C-channels 194', with the legs directed into the projectile-deflecting section 192. See FIG. 25. Such a configuration also adds further resistance in shear. Other structural shapes can be used, such as an I-beam or box-beam. As further illustrated in FIG. 25, the strips or channels can be placed on one or both sides of the projectile-deflecting section. The spacing between the strips or channels can be, for example, 2 to 10 inches. FIG. 26 illustrates an embodiment in which C-channels 194' are further affixed with bolts 195. FIG. 27 illustrates the C-channels and bolts on alternating sides of the projectile-deflecting section.

Figure 28:
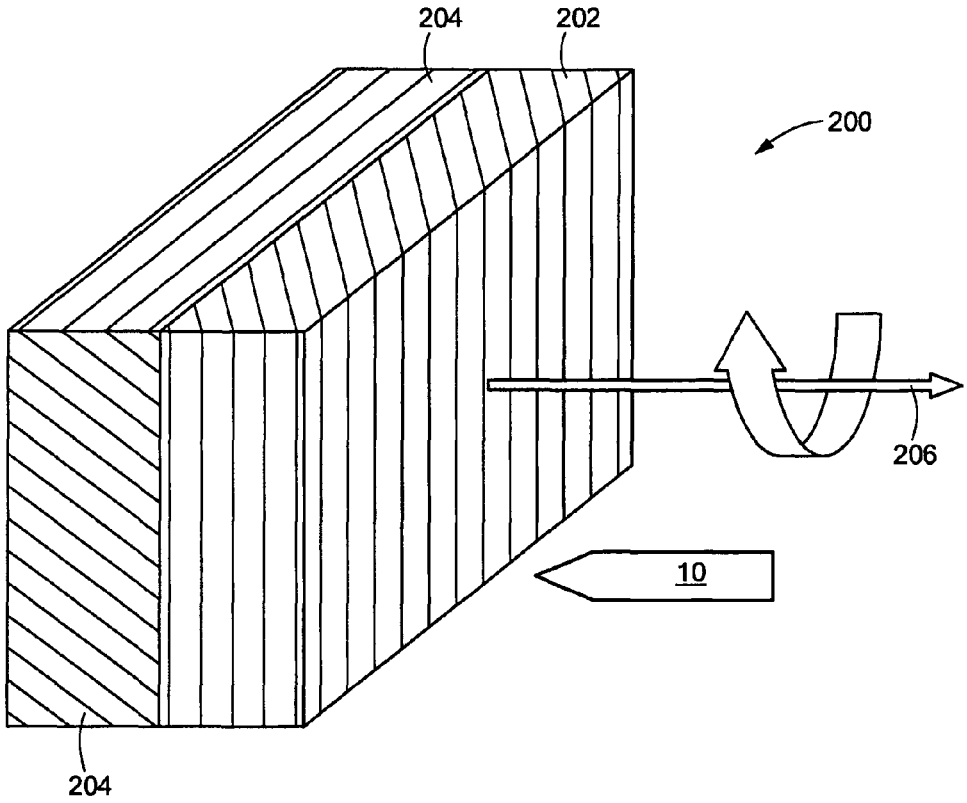
FIG. 28 schematically illustrates a further embodiment utilizing multiple sequential projectile-deflecting sections rotated about their surface normals.

FIG. 28 illustrates a further embodiment in which multiple sequential projectile-deflecting sections 202, 204 are rotated about their surface normals. In FIG. 28, a front section 202 is rotated 90° about the surface normal 206 relative to the second section 204. Two or more sequential sections can be used. The sections may or may not be contiguous. The layer angles may be the same or different from one section to the next. The sections may be rotated between 0° and 360° about the surface normal from one section to the next.

In another embodiment, a projectile-deflecting section can be formed of multiple layers of increasing molecular orientation from the outer surface through the thickness. One embodiment uses an ultra high molecular weight polyethylene plate on the front, as a non-oriented monolithic layer, followed by many layers of biaxially oriented film (biaxially oriented polyethylene terephthalate (PET) for example), which in turn is followed by layers of ultra high molecular weight polyethylene fiber in a urethane plastic, layered in a 0°, 90° fashion, commercially available as DYNEEMA®.

Figure 29:
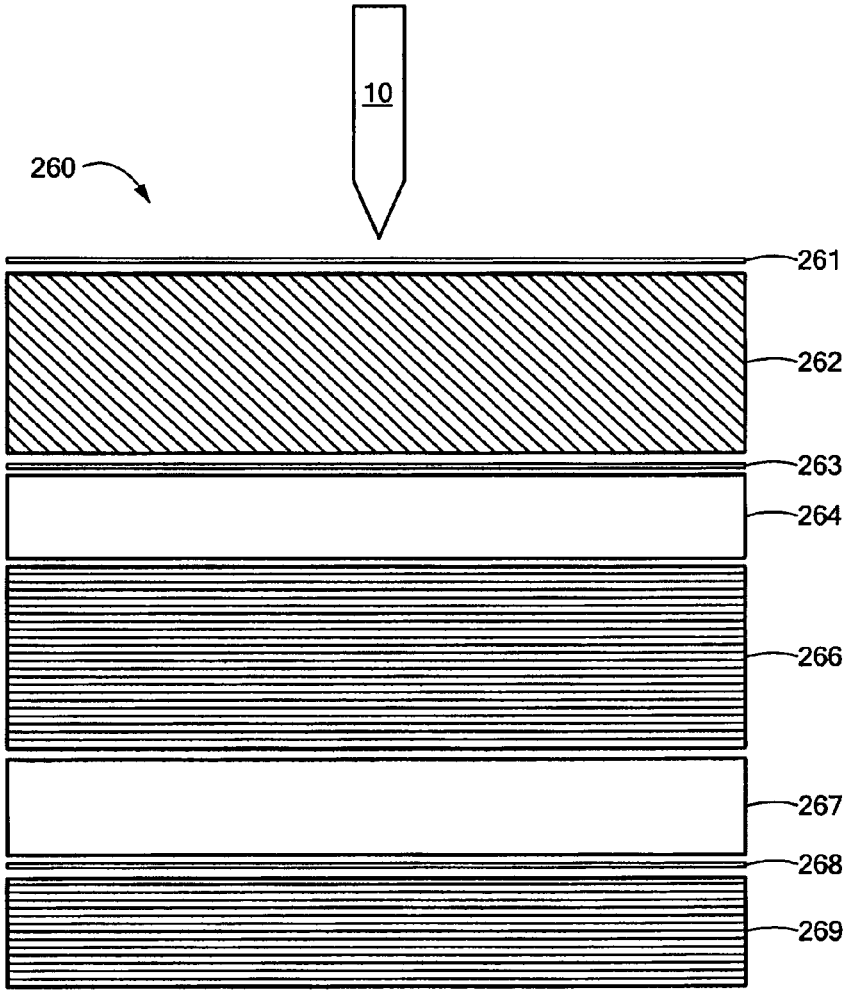
FIG. 29 schematically illustrates a further embodiment of an armor panel with a projectile-deflecting section.

FIG. 29 illustrates an embodiment in which a panel 260 employs a projectile-deflecting section 262 formed of an angled laminate of a material such as DYNEEMA® arranged in a 0°, 90° configuration, having a weight per unit area of 4.5 lb/ft$^2$. The layer planes are rotated 45° to the outer surface. The deflecting section is sandwiched between metal layers, such as an outer layer 261 (for example, of 5053 aluminum, 0.03 inch thick), and an inner layer 263 (for example of 6061 aluminum, 0.03 inch thick). The aluminum layers can be bonded to the angled DYNEEMA® material layers with a suitable adhesive, such as a urethane adhesive.

A layer 264 of reinforced ceramic tiles is located behind the inner metal layer 263. The tiles can be, for example, 8 mm thick, and laid in a brick lay pattern with offset seams. The tiles can be reinforced with a reinforcing material, such as a twisted wire reinforcement, such as HARDWIRE® reinforcement. The reinforcing material may be adhered to each surface of the tiles and laminated with a suitable adhesive, such as an epoxy resin.

An intermediate section 266, such as of DYNEEMA® material, is located behind the ceramic tile layer 264. The DYNEEMA® material intermediate section is a laminate, having a weight per unit area of 8 lb/ft$^2$, of layers in a 0°, 90° configuration parallel to the outer surface.

A further metal layer 268, such as of RHA steel, 0.06 inch thick, is located behind the intermediate section. The steel layer can be separated from the intermediate section by an air gap 267, such as with a standoff (not shown) of foam or another suitable material. The innermost section 269 is formed of a laminate of DYNEEMA® material arranged at 0°, 90°, having a weight per unit area of 3.0 lb/ft$^2$.

Figure 18:
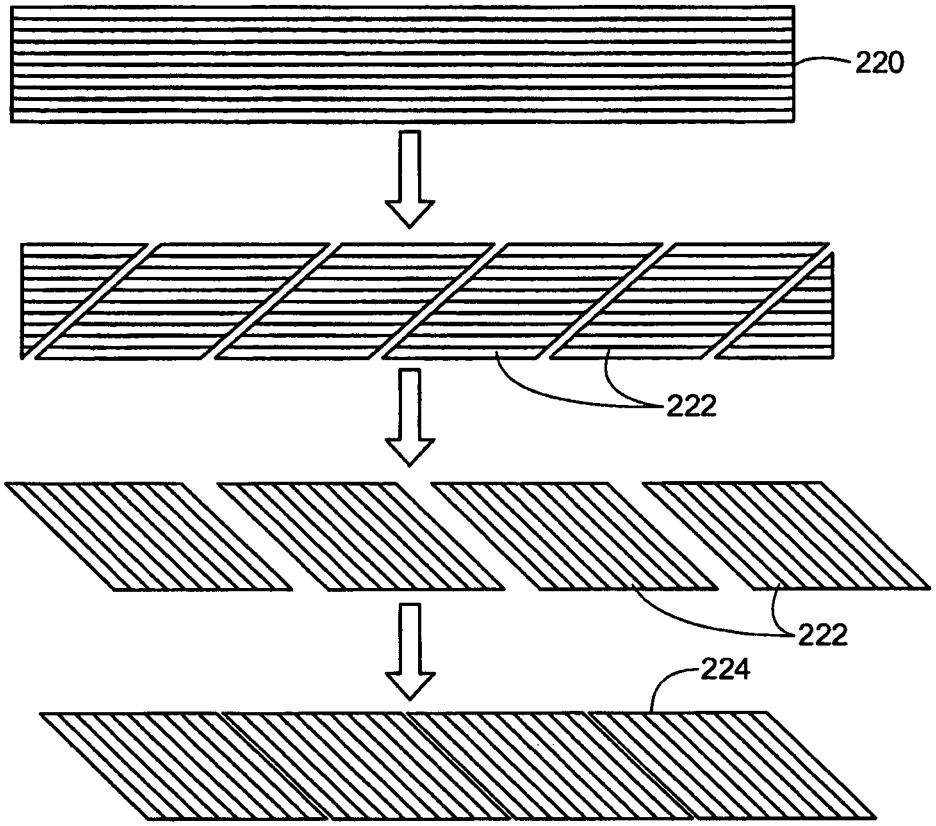
FIG. 18 schematically illustrates a method of manufacture of an orthotropic material.

The orthotropic material for the projectile-deflecting section can be manufactured by various methods. In one method, referring to FIG. 18, a laminate 220 is formed of a suitable material, such as layers of ultra high molecular weight polyethylene fibers embedded in a matrix material. The laminate is sliced into sections 222 at a desired angle, such as 45°. Each section is then rotated by 45° and reassembled. The sections are bonded to create a new laminate 224.

Layers can be stacked with or without consolidation of the lamination. Consolidation pressures can range from 500 psi or lower to 3500 psi. A gradient of laminating pressures can be provided, with the pressures increasing from lowest at an outwardly-facing surface to highest at an inner-facing surface. For example, a first group of layers can be laminated to a pressure 500 psi or lower, a middle group of layers at a pressure of 500-2500 psi, and a third group of layers at a pressure of 2500-3500 psi.

Figure 19:
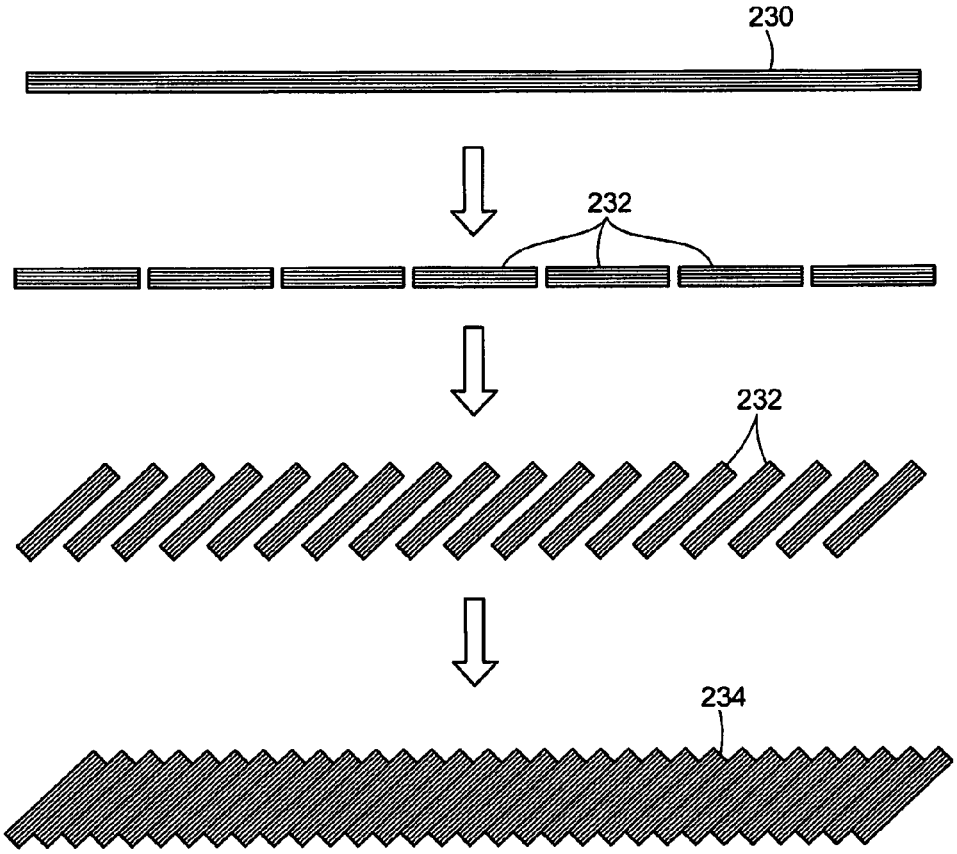
FIG. 19 schematically illustrates a further method of manufacture of an orthotropic material.

Referring to FIG. 19, a laminate 230 formed of a suitable material is sliced into strips 232 with perpendicular cuts. The strips are rotated 45° and reassembled. The strips are bonded to create a new laminate 234.

Figure 20:
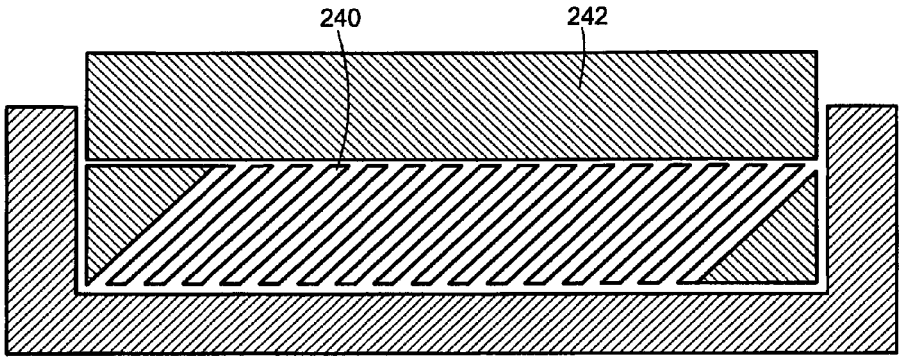
FIG. 20 schematically illustrates a further method of manufacture of an orthotropic material.

In another method, a layer 240 of a suitable material is folded into a zig-zag formation and pressed in a suitable mold 242. See FIG. 20.

Figure 21:
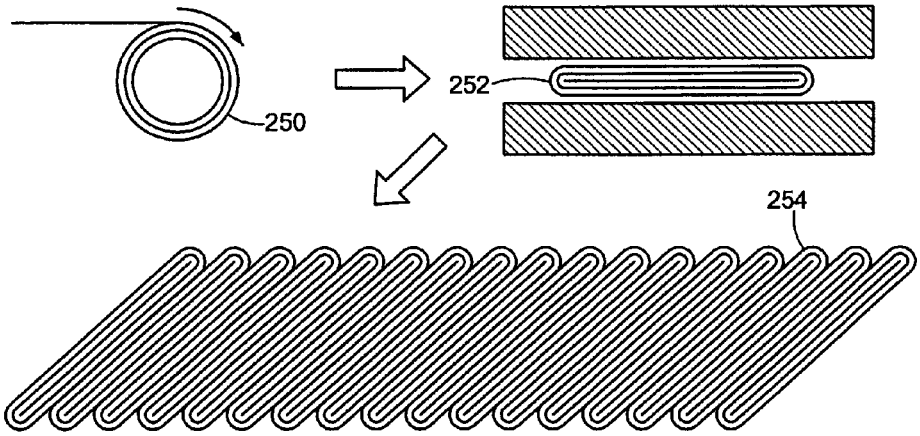
FIG. 21 schematically illustrates a further method of manufacture of an orthotropic material.

In another method, a material is rolled into a tube 250 and compressed into strips 252. The strips are rotated 45°. A number of strips are assembled and bonded into an angle layer panel 254, advantageously resulting in long fibers in the panel. See FIG. 21.

The invention is not to be limited by what has been particularly shown and described, except as indicated by the appended claims.

What is claimed is:

1. An armor panel comprising:

a first projectile-deflecting section having an outwardly facing surface, the first projectile-deflecting section comprising:

a macroscopically orthotropic material comprising a laminate of parallel layers, the layers arranged at a non-parallel angle to the outwardly facing surface, the macroscopically orthotropic material comprised of alternating layers of unidirectional ultra high molecular weight polyethylene fibers in a thermoplastic urethane resin pressed into a first laminate, the alternating layers of unidirectional fibers of the first laminate alternating by 90° with respect to adjacent layers within the first laminate;

a further projectile-deflecting section disposed inwardly of the first projectile-deflecting section and comprising:

a further macroscopically orthotropic material comprising a laminate of parallel layers, the layers arranged at a further non-parallel angle to the outer surface that is less than the non-parallel angle of the first projectile-deflecting section, the further macroscopically orthotropic material comprised of alternating layers of unidirectional ultra high molecular weight polyethylene fibers in a thermoplastic urethane resin pressed into a further laminate, the alternating layers of the unidirectional fibers of the further laminate alternating by 90° with respect to adjacent layers within the further laminate;

the macroscopically orthotropic material of the first projectile-deflecting section and the further macroscopically orthotropic material of the further projectile-deflecting section comprising a same material; and a ballistic layer attached to the further projectile-deflecting section parallel to the outwardly facing surface.

2. The armor panel of claim 1, wherein the non-parallel angle of the layers of the first projectile-deflecting section to the outer surface is between 10° and 90°.

3. The armor panel of claim 1, wherein the non-parallel angle of the layers of the further projectile-deflecting section to the outer surface is approximately 45°.

4. The armor panel of claim 1, wherein each of the parallel layers is comprised of a unidirectional material stacked in an alternating orthogonal configuration.

5. The armor panel of claim 1, wherein the further non-parallel angle comprises an alternating non-parallel angle to the outer surface from the non-parallel angle of the first projectile-deflecting section.

6. An armor panel system comprising the armor panel of claim 1, wherein the armor panel of claim 1 is attached to a structure.

* * * * *